US009381747B2

(12) United States Patent
Nakao

(10) Patent No.: US 9,381,747 B2
(45) Date of Patent: Jul. 5, 2016

(54) FLOW PATH COMPONENT, LIQUID EJECTING APPARATUS, AND METHOD FOR MANUFACTURING FLOW PATH COMPONENT

(71) Applicant: Seiko Epson Corporation, Tokyo (JP)

(72) Inventor: Hajime Nakao, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/168,401

(22) Filed: Jan. 30, 2014

(65) Prior Publication Data

US 2014/0218446 A1 Aug. 7, 2014

(30) Foreign Application Priority Data

Feb. 1, 2013 (JP) ..... 2013-018384

(51) Int. Cl.
*B41J 2/175* (2006.01)
*B41J 2/14* (2006.01)
*B41J 2/16* (2006.01)

(52) U.S. Cl.
CPC ..... *B41J 2/175* (2013.01); *B41J 2/14233* (2013.01); *B41J 2/1606* (2013.01); *B41J 2202/03* (2013.01); *B41J 2202/11* (2013.01)

(58) Field of Classification Search
CPC ..... B41J 2/1606; B41J 2/1618; B41J 2/1623; B41J 2/1642; B41J 2/14201
USPC ..... 347/85
See application file for complete search history.

(56) References Cited

U.S. PATENT DOCUMENTS 6,808,250 B2 * 10/2004 Watanabe ..... B41J 2/14209 347/45
2007/0211117 A1 * 9/2007 Kitani ..... B41J 2/14129 347/63
2009/0115817 A1 * 5/2009 Suzuki ..... B41J 2/14274 347/45
2009/0229126 A1 * 9/2009 Oguri ..... B41J 2/055 29/890.1
2013/0208057 A1 * 8/2013 Hays ..... B41J 2/14233 347/84

FOREIGN PATENT DOCUMENTS

JP 2012-201025 A 10/2012

* cited by examiner

*Primary Examiner* — Geoffrey Mruk
*Assistant Examiner* — Scott A Richmond
(74) *Attorney, Agent, or Firm* — Harness, Dickey & Pierce, P.L.C.

(57) ABSTRACT

A flow path component includes a first flow path member that includes a first flow path, a second flow path member that includes a second flow path which communicates with the first flow path, a covering layer that coats a wall surface of the first flow path, and an adhesion layer that adheres the first flow path member and the second flow path member with each other and covers at least a part of an end portion of the covering layer. Also, at least a part of the first flow path of the first flow path member is configured as a pressure chamber that applies pressure to a liquid which is supplied.

14 Claims, 6 Drawing Sheets

FLOW PATH COMPONENT, LIQUID EJECTING APPARATUS, AND METHOD FOR MANUFACTURING FLOW PATH COMPONENT

BACKGROUND

1. Technical Field

The present invention relates to a flow path component, a liquid ejecting apparatus, and a method for manufacturing a flow path component.

2. Related Art

In a flow path component that includes a liquid flow path through which a liquid passes formed therein and is formed of ceramics, an outflow opening that causes the liquid in the liquid flow path to flow out of the flow path component is formed as one end portion of the liquid flow path, and a flow path wall surface constituting the liquid flow path is covered by a protective film of a paraxylene-based polymer (refer to JP-A-2012-201025). A member that has a communication hole communicating with the outflow opening is bonded to an outer wall surface of the flow path component where the outflow opening is formed as a member separate from the flow path component.

The protective film is disposed in order to improve water resistance, chemical resistance, insulation properties, heat resistance, strength and the like (collectively referred to as durability) of the flow path wall surface. Herein, there is a concern that a part of an end of the protective film in the vicinity of the outflow opening may be peeled off from the flow path wall surface due to exposure to the flow of the liquid in the liquid flow path. A part of the protective film that is peeled off may inhibit the flow of the liquid and air bubbles in the liquid. Also, when a part of the protective film that is peeled off drops (is torn off) to float in the liquid flow path and the communication hole and turn into a foreign substance, the flow of the liquid and the air bubbles in the liquid may be further inhibited and stable ejection of the liquid may be hindered.

SUMMARY

An advantage of some aspects of the invention is to provide a flow path component that can prevent peeling and dropping of a predetermined layer (film) in a flow path and, as a result, can achieve stable flow of a liquid, a liquid ejecting apparatus, and a method for manufacturing the flow path component.

According to an aspect of the invention, a flow path component includes a first flow path member that includes a first flow path, a second flow path member that includes a second flow path which communicates with the first flow path, a covering layer that coats a wall surface of the first flow path, and an adhesion layer that adheres the first flow path member and the second flow path member with each other and covers at least a part of an end portion of the covering layer.

In this configuration, the end portion of the covering layer that coats the wall surface of the first flow path is covered by the adhesion layer that adheres the first flow path member and the second flow path member with each other. Accordingly, a state where the end portion is likely to be peeled off as in the related art can be addressed, and the stable flow of the liquid in the flow path component can be achieved.

According to the aspect of the invention, at least a part of the first flow path of the first flow path member may be a pressure chamber that applies pressure to a liquid which is supplied.

It is preferable that the pressure chamber be protected by the covering layer because durability of the wall surface thereof is required. In this configuration, the peeling of the end portion of the covering layer that coats the flow path (first flow path) including the pressure chamber can be prevented.

According to the aspect of the invention, the second flow path member may include a nozzle which ejects a liquid passing through the first flow path and may include a flow path which causes the first flow path and the nozzle to communicate with each other as the second flow path.

In this configuration, the flow of the liquid continuous from the first flow path to the nozzle and the ejection of the liquid from the nozzle can be performed in a stable manner.

According to the aspect of the invention, the adhesion layer may cover a peeling section that is peeled off from the wall surface of the first flow path in an end portion of the covering layer.

In manufacturing the flow path component, there is a case where a part of the end portion is peeled off from the wall surface of the first flow path when a part of the end portion of the covering layer is torn or broken. In this configuration, even in a case where the peeling section that is peeled is present, the peeling section is prevented from being shaken or dropping in the first flow path since the peeling section is covered by the adhesion layer, and thus the stable flow of the liquid in the flow path component can be achieved.

Various materials can be used in the covering layer. For example, the covering layer may be a protective film formed of a paraxylene-based polymer.

The technical idea according to the invention may be embodied by various forms not limited to the flow path component. For example, an apparatus (liquid ejecting head and liquid ejecting apparatus) mounted with the flow path component can be regarded as one invention, and a part of the flow path component can be regarded as one invention. Also, a method for manufacturing the above-described flow path component can be regarded as one invention. For example, the method for manufacturing a flow path component including a first flow path member that includes a first flow path, and a second flow path member that includes a second flow path which communicates with the first flow path and is adhered with the first flow path member includes forming a covering layer that coats a wall surface of the first flow path, applying or attaching an adhesive to at least one of a surface of the first flow path member on a side which is adhered with the second flow path member and a surface of the second flow path member on a side which is adhered with the first flow path member, and covering at least a part of an end portion of the covering layer, after adhering the second flow path member and the first flow path member with each other via the adhesive and causing a part of the adhesive to enter the first flow path from an opening of the first flow path, by using the adhesive which enters the first flow path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described referring to the accompanying drawings.

Figure 1:
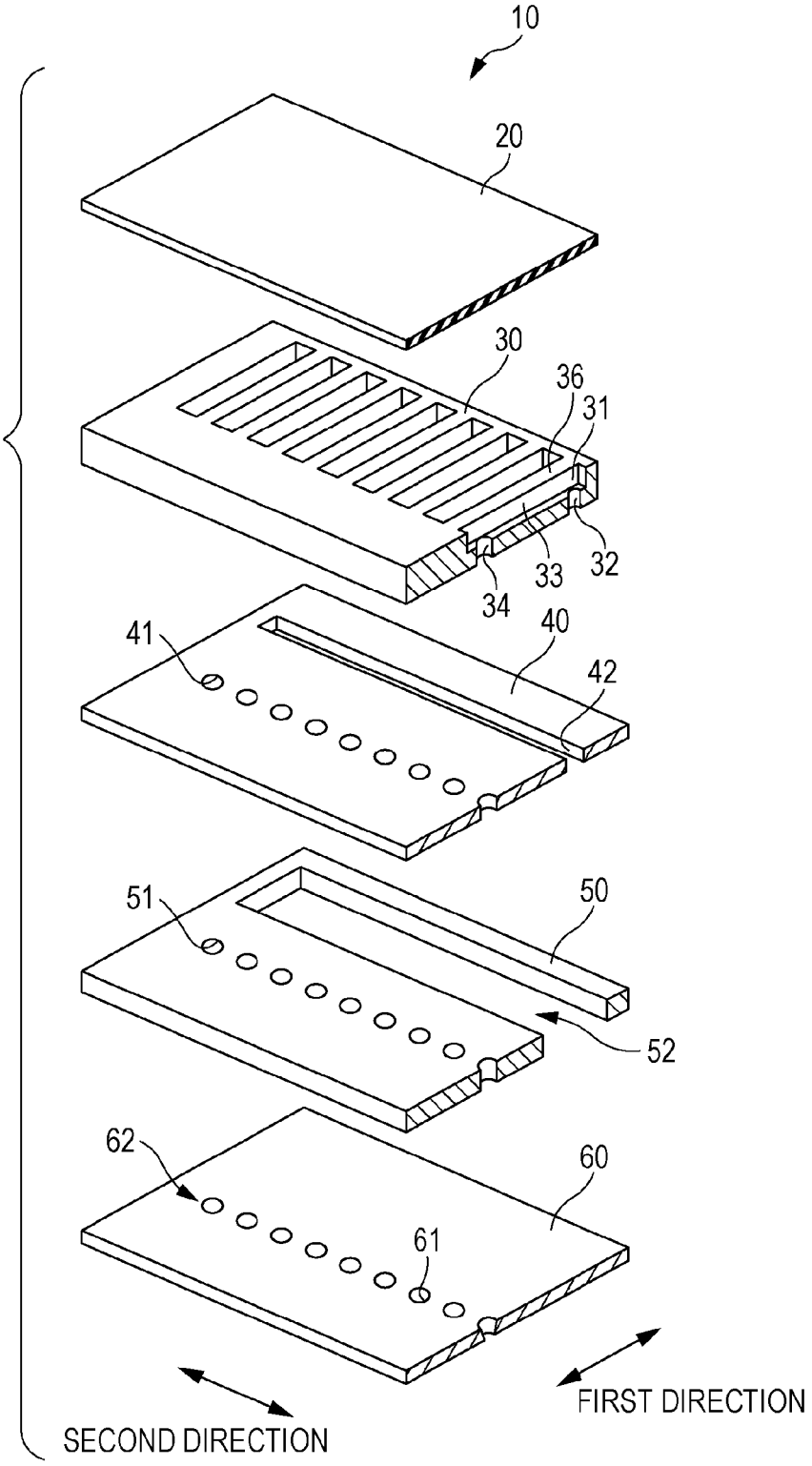
FIG. 1 is an exploded perspective view illustrating a part of a main configuration of a liquid ejecting head.

FIG. 1 is an exploded perspective view illustrating a part of a main configuration of a liquid ejecting head 10 according to this embodiment. Herein, an ink jet type recording head that ejects (discharges) ink is described as the liquid ejecting head 10. The liquid ejecting head 10 is configured to include each of the following members of a vibrating plate 20, a flow path substrate 30, a sealing plate 40, a reservoir plate 50, and a nozzle plate 60. The flow path substrate 30 corresponds to an example of a first flow path member according to an aspect of the invention. These members may be individually formed and stacked or these members (or some of these members) may be integrally formed. Also, the liquid ejecting head 10 may be configured to include a member other than the members shown in FIG. 1 or may be configured not to include some of the members shown in FIG. 1.

The vibrating plate 20 seals one surface of the flow path substrate 30, and is mounted with a piezoelectric element 70 (refer to FIG. 2) on a surface on the opposite side to a surface in contact with the flow path substrate 30. The vibrating plate 20 is formed of ceramics or the like or the vibrating plate 20 has, for example, an elastic film formed of an oxide film which is in contact with the flow path substrate 30 and an insulator film which is formed from an oxide film using a different material than the elastic film and is stacked on the elastic film. In the invention, objects being "in contact" with each other means both of a state where an adhesive or the like is interposed between the objects and a state where nothing is interposed between the objects.

The flow path substrate 30 has a plurality of liquid flow paths 31. The flow path 31 corresponds to an example of a first flow path according to an aspect of the invention. The flow paths 31 are arranged in a second direction that is orthogonal to a first direction which is parallel with a longitudinal direction thereof. A partition wall 36 is disposed between the flow path 31 and the flow path 31. In this specification, directions, positions and the like of the components of the liquid ejecting head 10 being expressed to be, for example, parallel, orthogonal, or identical to each other means not only that these are strictly parallel, orthogonal, or identical to each other but also that these are with a tolerance acceptable for product performance and a tolerance acceptable in product manufacturing.

Each of the flow paths 31 is configured to have a supply hole 32, a pressure chamber 33, and a communication hole 34. The pressure chamber 33 is open on the one surface of the flow path substrate 30, and the supply hole 32 and the communication hole 34 are open on the other surface of the flow path substrate 30. The supply hole 32 communicates with the pressure chamber 33 in the vicinity of one longitudinal direction end side of the pressure chamber 33. The communication hole 34 communicates with the pressure chamber 33 in the vicinity of the other longitudinal direction end side of the pressure chamber 33.

The nozzle plate 60 has a plurality of nozzles 61 as through-holes through which the ink is ejected. In the example of FIG. 1, the nozzle plate 60 has a nozzle array 62 where the plurality of nozzles 61 are formed at predetermined intervals along the second direction. The nozzle plate 60 may adopt a configuration in which a plurality of nozzle arrays where the plurality of nozzles 61 are formed along the second direction are arranged in the first direction and one of the nozzle arrays and another one of the nozzle arrays are placed in a shifted manner in the second direction (so-called staggered arrangement).

Each of the communication holes 34 of the flow paths 31 causes each of the pressure chambers 33 and each of the nozzles 61 to communicate one-on-one with each other. In the example of FIG. 1, the sealing plate 40 and the reservoir plate 50 are interposed between the other surface of the flow path substrate 30 and the nozzle plate 60. One surface of the sealing plate 40 is in contact with the other surface of the flow path substrate 30. One surface of the reservoir plate 50 is in contact with the other surface of the sealing plate 40. Also, the other surface of the reservoir plate 50 is in contact with the surface of the nozzle plate 60 on the opposite side to a surface thereof which is exposed to the outside (nozzle opening surface). Each of the flow path substrate 30, sealing plate 40, reservoir plate 50, and nozzle plate 60 is formed of, for example, ceramics, a silicon single crystal substrate, and stainless steel.

The reservoir plate 50 has a plurality of second communication holes 51 and a reservoir 52. The reservoir 52 is referred to as a common ink chamber. Both of the second communication holes 51 and the reservoir 52 penetrate the reservoir plate 50. Each of the second communication holes 51 is placed at a position corresponding one-on-one to each of the nozzles 61. The length of the reservoir 52 in the second direction is ensured in such a manner as to substantially correspond to the length of the nozzle array in the second direction. The sealing plate 40 has a plurality of first communication holes 41 and a common supply hole 42. Both of the first communication holes 41 and the common supply hole 42 penetrate the sealing plate 40. Each of the first communication holes 41 is placed at a position corresponding one-on-one to each of the nozzles 61 as is the case with each of the second communication holes 51. Also, each of the first communication holes 41 communicates one-on-one with each of the communication holes 34. The length of the common supply hole 42 in the second direction is ensured in such a manner as to substantially correspond to the length of the nozzle array 62 in the second direction as is the case with the reservoir 52. Also, the common supply hole 42 communicates with each of the supply holes 32. The reservoir 52 (excluding an ink supply path from the outside that will be described later) is sealed by the nozzle plate 60 on a side in contact with the nozzle plate 60, and is sealed by the sealing plate 40 on a side in contact with the sealing plate 40 excluding a portion which corresponds to the common supply hole 42.

In this configuration, the sealing plate 40 corresponds to an example of a second flow path member that has a second flow path which communicates with the first flow path (flow path 31) according to an aspect of the invention. In a case where the sealing plate 40 is the second flow path member, the first communication hole 41 corresponds to the second flow path according to an aspect of the invention. Also, in a case where the sealing plate 40 is the second flow path member, a configuration that has the flow path substrate 30 and the sealing plate 40 corresponds to an example of a "flow path component" according to an aspect of the invention. In other words, the liquid ejecting head 10 includes the flow path component in the configuration thereof.

Figure 2:
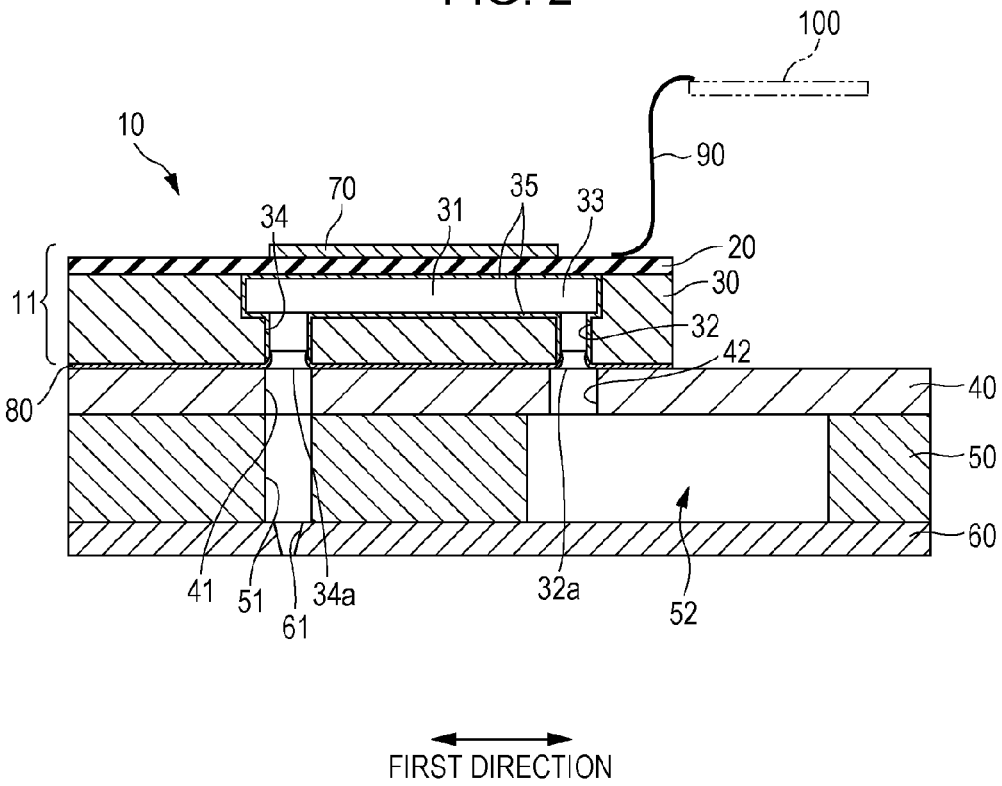
FIG. 2 is a cross-sectional view showing a cross section through a nozzle.

FIG. 2 shows a cross section of the liquid ejecting head 10 shown in FIG. 1 from a point of view facing the second direction. The cross section shown in FIG. 2 is a cross section through the nozzles 61 of the nozzle array 62. As shown in FIG. 2, the pressure chamber 33 communicates with the nozzles 61 via the communication holes 34, first communication holes 41, and the second communication holes 51. The piezoelectric element 70 is mounted on the surface of the vibrating plate 20 on the opposite side to the surface in contact with the flow path substrate 30. As is known, the piezoelectric element 70 is disposed on each of the pressure chambers 33 to correspond to positions of the pressure chambers 33. An individual electrode and a common electrode, which are not shown herein, are connected to the piezoelectric element 70, and the piezoelectric element 70 is deformed when voltage supplied from the circuit substrate 100 which drives the liquid ejecting head 10 is applied via cables (flexible substrate or the like) 90 to the electrodes. The vibrating plate 20 on which the piezoelectric element 70 and each of the above-described electrodes are mounted and the flow path substrate 30 can be collectively referred to as an actuator substrate 11.

The ink is supplied from the outside to the reservoir 52 via the ink supply path that is not shown herein. The ink that is supplied to the reservoir 52 passes through the common supply hole 42 and is supplied to each of the pressure chambers 33 from each of the supply holes 32. The above-described deformation of the piezoelectric element 70 causes the vibrating plate 20 to be bent and pressure in the pressure chamber 33 to increase. The ink in the pressure chamber 33 is ejected from the nozzles 61 in response to the increase in the pressure.

Herein, the flow path substrate 30 is a member that is subjected to the change in the pressure caused by the above-described bending of the vibrating plate 20, and can be considered as a member in which damage such as a crack is likely to occur on wall surfaces of the flow path 31. Also, when the wall surface of the flow path 31 is damaged, an adverse effect such as the ink leaking outside is likely to occur. As such, in this embodiment, the wall surfaces (surfaces of the vibrating plate 20 facing the supply hole 32, pressure chamber 33, communication hole 34, and an inner portion of the pressure chamber 33) of the flow path 31 are coated with a protective film 35 (covering layer) as shown in FIG. 2 so that durability of the wall surfaces is improved. An organic film, a metal film or the like can be adopted as the protective film 35, but a paraxylene-based polymer is adopted in this embodiment. Also, in a case where the wall surface of the flow path 31 is covered with the protective film 35, there is a concern that a part of an end portion of the protective film 35 may be peeled off from the wall surface as the end portion is exposed to a flow of the ink in the flow path. Also, there is a case where the end portion is peeled off from the wall surface while the protective film 35 is formed on the wall surface of the flow path 31. As such, in this embodiment, at least a part of the end portion of the protective film 35 is configured to be covered by a layer of an adhesive (adhesion layer 80) which adheres the first flow path member (flow path substrate 30) to the second flow path member (for example, sealing plate 40).

Figure 3:
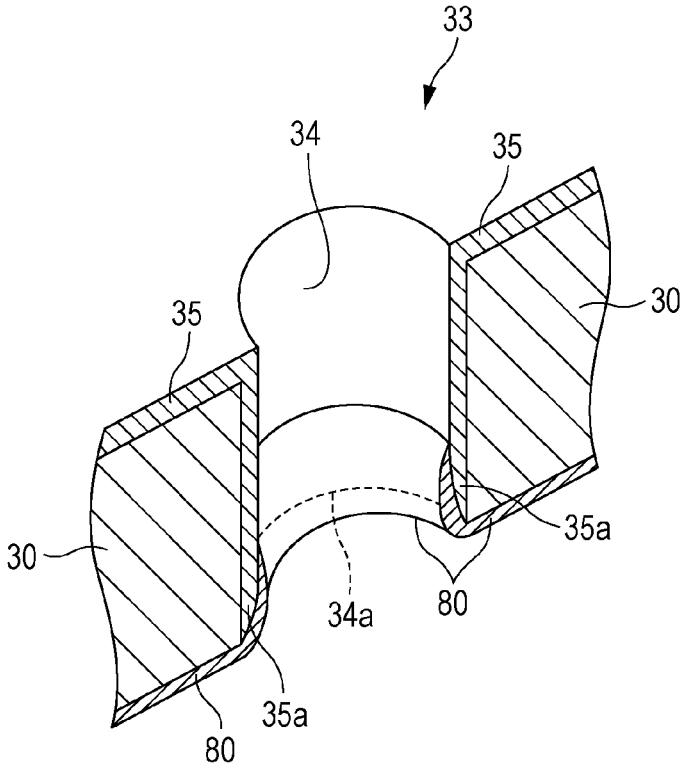
FIG. 3 is a perspective cross-sectional view of the vicinity of a communication hole.

FIG. 3 is a perspective cross-sectional view that shows in detail how an end portion 35*a* of the protective film 35 is covered by the adhesion layer 80. FIG. 3 shows the vicinity of the communication hole 34 as a part of the flow path 31 of the flow path substrate 30. As described above, the wall surface of the flow path 31 (the pressure chamber 33 and the communication hole 34 shown in FIG. 3) is coated with the protective film 35. Also, the communication hole 34 has an opening 34*a* (refer also to FIG. 2 if necessary) that communicates with a nozzle 61 side (sealing plate 40 side), and a part of the protective film 35 that coats the wall surface in the vicinity of the opening 34*a* corresponds to the end portion 35*a* of the protective film 35. The end portion 35*a* is covered by the adhesion layer 80 that partially enters the communication hole 34 from the opening 34*a*.

By adopting this configuration, the end portion 35*a* is prevented from being directly exposed to the flow of the ink when the ink flows in the flow path 31 and a flow path (first communication hole 41 and the like) on the nozzle 61 side which is connected to the flow path 31. As a result, the peeling of the end portion 35*a* from the wall surface of the flow path 31 and dropping caused by the progress of the peeling are avoided, and various adverse effects such as inhibition of the flow of the ink and air bubbles in the ink caused by the peeled or dropped end portion 35*a* and clogging of the end portion 35*a* which is turned into a foreign substance in the nozzle 61 are also prevented. In other words, according to this embodiment, stable liquid ejection is achieved by covering the end portion 35*a* of the protective film 35 with the adhesion layer 80. Also, this is the same as the vicinity of an opening 32*a* (refer to FIG. 2) of the supply hole 32 of the flow path substrate 30 communicating with the sealing plate 40 side, and the end portion of the protective film 35 facing the opening 32*a* is covered by the adhesion layer 80.

Next, a method for manufacturing the liquid ejecting head 10 including the flow path component according to this embodiment will be described.

Figure 4:
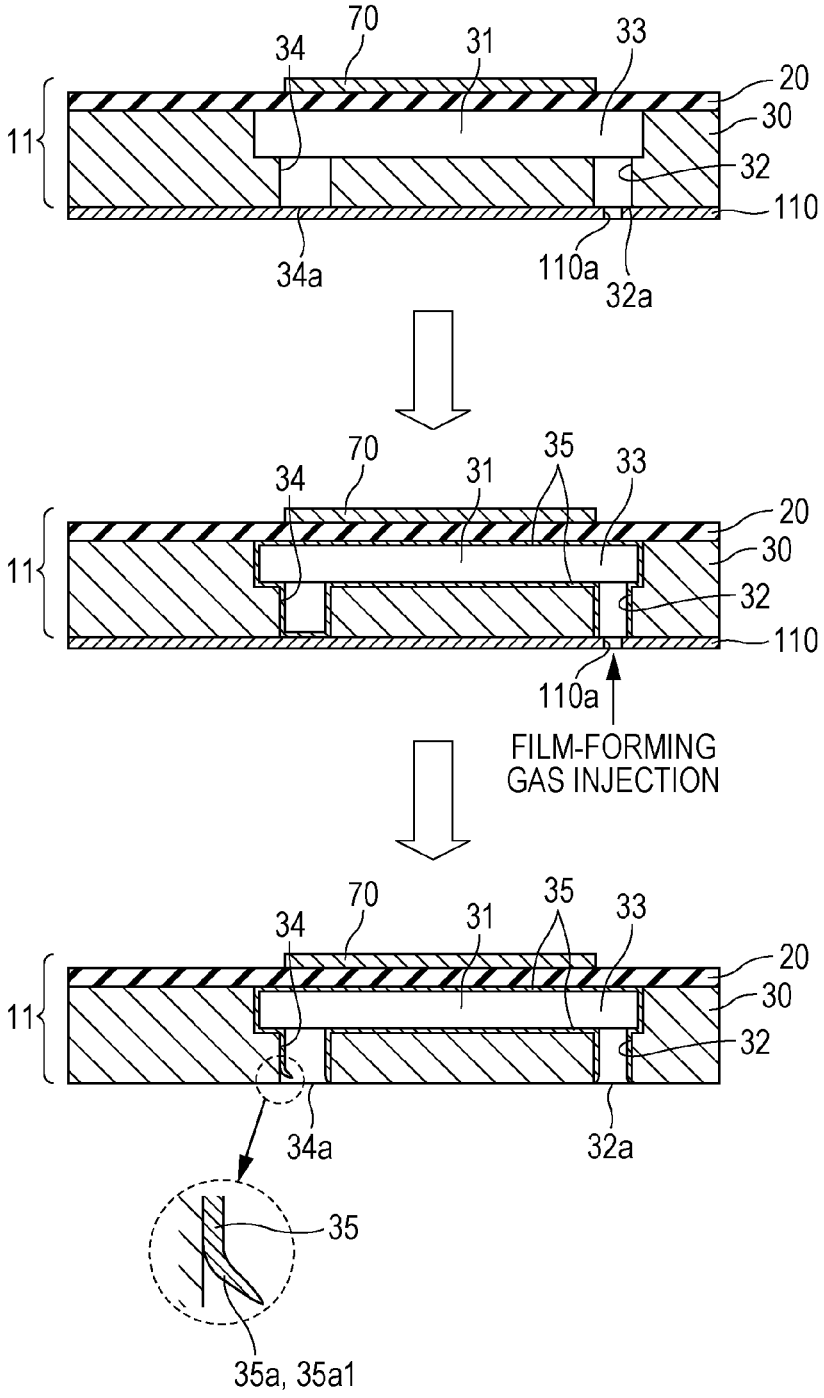
FIG. 4 is a view illustrating a part of a method for manufacturing the liquid ejecting head.
Figure 5:
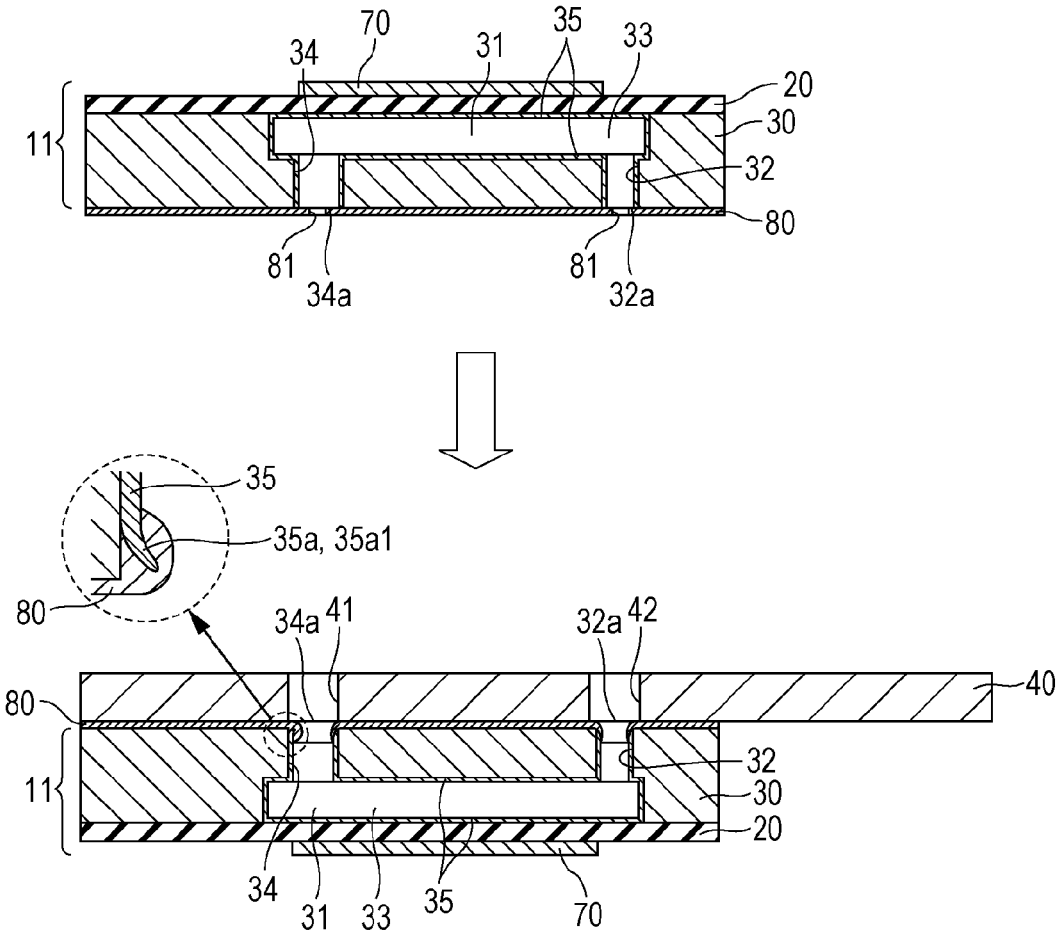
FIG. 5 is a view illustrating a part of the method for manufacturing the liquid ejecting head.

FIGS. 4 and 5 illustrate a part of the method for manufacturing the liquid ejecting head 10 by using the same cross section as in FIG. 2. The upper section of FIG. 4 shows attaching a seal 110 to a surface (hereinafter, target surface) of the first flow path member (flow path substrate 30) on a side that is adhered to the second flow path member (for example, sealing plate 40). The seal 110 is attached to the target surface while preparing the protective film 35 to be formed in the flow path 31 in the flow path substrate 30. When a component of the protective film 35 is attached to the target surface, there is a concern that an adhesive force may decrease during the adhesion between the target surface and the second flow path member, and thus the seal 110 is attached so as to prevent the component of the protective film 35 from being attached to the target surface. The seal 110 has a film-forming gas injection hole 110*a* at each of positions facing the openings 32*a* among the openings 32*a* and 34*a* formed in the target surface. The opening area of the hole 110*a* is smaller than the opening area of the opening 32*a*.

The middle section of FIG. 4 shows forming the protective film 35 to coat the wall surface of the flow path in the flow path substrate 30. Specifically, film-forming gas that contains the component of the protective film 35 is injected from the hole 110*a* of the seal 110, and the protective film 35 is formed on the wall surface of the flow path 31. In this embodiment, the hole 110*a* of the seal 110 is formed not at a position corresponding to the opening 34*a* but at a position corresponding to the opening 32*a* as described above, and this is because of the following reason. The pitch of the communication holes 34 in the second direction (refer to FIG. 1) is equal to the pitch of the nozzles 61 in the second direction, and thus densification is in progress for densification of the nozzles 61 of recent days. A high-precision operation is required to position the hole 110*a* for each of the openings 34*a* of the communication holes 34 that are arranged in the second direction with the narrow interval. If a deviation is present at the positions of each of the openings 34*a* and each of the holes 110*a*, there is a possibility that the film-forming gas may be in contact with a part of the target surface as well as a possibility that the film-forming gas may not be sufficiently spread in the flow path 31.

The supply hole 32 is a path that supplies the ink from a reservoir 52 side to the pressure chamber 33. Accordingly, the supply hole 32 has only to be capable of equally supplying the ink to each of the pressure chambers 33, and thus is not limited to the configuration shown in FIG. 1 where one supply hole 32 is present to correspond to the one pressure chamber 33 but, for example, the ink can be supplied by one supply hole 32 to a plurality of the pressure chambers 33. In other words, the supply hole 32 in the second direction does not have to be as dense as the communication hole 34 and the nozzle 61, and thus it can be said that there is a case where the operation to position each of the holes 110*a* of the seal 110 at each of the openings 32*a* is less difficult than an operation to position each of the holes 110*a* at each of the openings 34*a*. Because of this reason, the hole 110*a* of the seal 110 is formed at the position corresponding to the opening 32*a*.

The lower section of FIG. 4 shows a state where the seal 110 is peeled off from the target surface after the formation of the protective film 35. When the seal 110 is peeled off from the target surface, there is a case where the protective film 35 that coats the wall surfaces of the flow path 31 in the vicinity of the openings 32*a* and 34*a* is pulled by the protective film 35 that is attached to a surface of the seal 110 directed into the flow path 31 to be partially damaged or peeled off. The lower section of FIG. 4 is an example thereof and, in the large circle shown with the chain line, the end portion 35*a* of the protective film in the vicinity of the opening 34*a* and the like is extracted to be illustrated in an enlarged manner. The enlarged illustration shows the end portion 35*a* (peeling section 35*a*1) that is in a state of being peeled off from the wall surface of the flow path 31 through an operation to peel off the seal 110. When the peeling section 35*a*1 that is formed through the manufacturing of the flow path component in this manner is left as it is, the flow of the ink and the like may be inhibited and stable ink ejection may be hindered. As such, in this embodiment, the end portion 35*a* of the protective film 35 including the peeling section 35*a*1 is covered with the adhesion layer 80 as described later.

The upper section of FIG. 5 shows applying or attaching the adhesive to the target surface excluding at least a part of ranges of the openings 32*a* and 34*a* of the flow path 31. Specifically, a sheet-like thermo-compression adhesive (adhesion sheet) is attached to the target surface. The adhesion sheet is an example of the adhesion layer 80.

A substantially circular hole 81 that corresponds to the position of each of the openings 32*a* and each of the openings 34*a* is formed in advance through hollowing out on the adhesion sheet (80). The opening area of the hole 81 is smaller than the opening area of any of the openings 32*a* and 34*a*. Accordingly, when the configuration shown in the upper section of FIG. 5 is viewed from an adhesion sheet (80) side, each of the holes 81 is placed in a state of being put into an inner side of each of the corresponding openings 32*a* and 34*a*.

After the adhesion sheet (80) is attached to the target surface as described above, the actuator substrate 11 is placed in such a manner that the target surface is directed to a vertical direction upper side as shown in the lower section of FIG. 5, and a member in contact with the target surface (sealing plate 40 in the example of FIGS. 1, 2, and 5) is pressed against the adhesion sheet (80) and heat is applied to the adhesion sheet (80). In this manner, the target surface and the member are thermo-compressed. In this case, an edge part of the hole 81 that is a part of the adhesion sheet (80) which is temporarily softened by the heat enters the flow path 31 (supply hole 32 and communication hole 34) from the openings 32*a* and 34*a* for the pressure caused by the pressing of the member and the gravity. A part of the adhesion sheet (80) that enters the flow path 31 is cooled and cured while moving along an outer side of the protective film 35 and covering the end portion 35*a* of the protective film 35 which is already formed. As a result, as shown in the lower section of FIG. 5 and FIGS. 2 and 3, the end portion 35*a* of the protective film 35 is covered by the adhesion layer 80 which is hardened. Also, in a case where the adhesive is not a thermo-compression adhesive, the heat may not be applied but the adhesion is performed by a method corresponding thereto.

The lower section of FIG. 5 is an example and, in the large circle shown with the chain line, the end portion 35*a* of the protective film 35 in the vicinity of the opening 34*a* and the like is extracted (reversing the up-and-down direction) to be illustrated in an enlarged manner. As shown in the enlarged illustration, the end portion 35*a* that is the peeling section 35*a*1 is also covered by the adhesion layer 80, and thus the peeling section 35*a*1 is not exposed later to the flow of the ink and the peeling section 35*a*1 does not inhibit the flow of the ink to hinder the stable ink ejection. Also, a timing when the actuator substrate 11 is placed in such a manner that the target surface is directed to the vertical direction upper side may be earlier than a timing of attaching the adhesion sheet (80) to the target surface. Also, the adhesion sheet (80) may not be attached to the target surface but may be attached to a surface (hereinafter, second target surface) of the member (sealing plate 40 in FIGS. 1, 2, and 5) in contact with the target surface on a flow path substrate 30 side. Further, the adhesion sheet (80) may be attached to both of the target surface and the second target surface. Even in this case, it is preferable that the adhesion be performed by placing the actuator substrate 11 in such a manner that the target surface is directed to the vertical direction upper side. Then, the reservoir plate 50 and the nozzle plate 60 are mounted, and connected to the circuit substrate 100 or the like so that the liquid ejecting head 10 is manufactured. According to the manufacturing method, the end portion 35*a* of the protective film 35 can be easily and reliably covered by the originally required material of the adhesive.

Other Embodiments

The invention is not limited to the above-described embodiment, but various modifications are possible without departing from the scope of the invention. For example, the following embodiments are also possible.

The liquid ejecting head 10 does not necessarily have to include the sealing plate 40 and the reservoir plate 50, but may include another plate such as a so-called compliance plate. Further, the liquid ejecting head 10 may be configured to include a plurality of these plates or may be configured to include a single plate which has functions of the plurality of plates. Also, the nozzle plate 60 and the so-called compliance plate may be adhered to the target surface by the adhesion layer 80. For example, in a configuration in which the nozzle plate 60 is adhered to the target surface via the adhesion layer 80, the nozzle plate 60 corresponds to the second flow path member and the nozzle corresponds to the second flow path. Also, in a case where the nozzle plate 60 is the second flow path member, the configuration including the flow path substrate 30 and the nozzle plate 60 corresponds to an example of the "flow path component" according to an aspect of the invention. In this case, for example, a configuration in which the flow path substrate 30 has a part of the reservoir which supplies the ink to each of the pressure chambers 33 may be adopted.

Also, a pressure generation unit that generates the change in the pressure in the pressure chamber 33 is not limited to the thin film type piezoelectric element shown in FIGS. 2, 4, and 5 but, for example, a stacked type piezoelectric actuator in which a piezoelectric material and an electrode material are alternately stacked or a longitudinal vibration type pressure generation unit that applies a change in pressure to each of the pressure chambers 33 through longitudinal vibration may be adopted. Also, one in which a heating element is placed in a pressure chamber and ejects droplets from a nozzle by using bubbles generated by heat generation of the heating element or a so-called electrostatic actuator that generates static electricity between a vibrating plate and an electrode, deforms the vibrating plate by using the static electricity, and ejects droplets from a nozzle can be used as the pressure generation unit.

Also, the liquid ejecting head 10 constitutes a part of an ink jet type recording head unit that includes an ink supply path which communicates with an ink cartridge or the like, and is mounted on an ink jet printer 200. The ink jet printer 200 is an example of a liquid ejecting apparatus.

Figure 6:
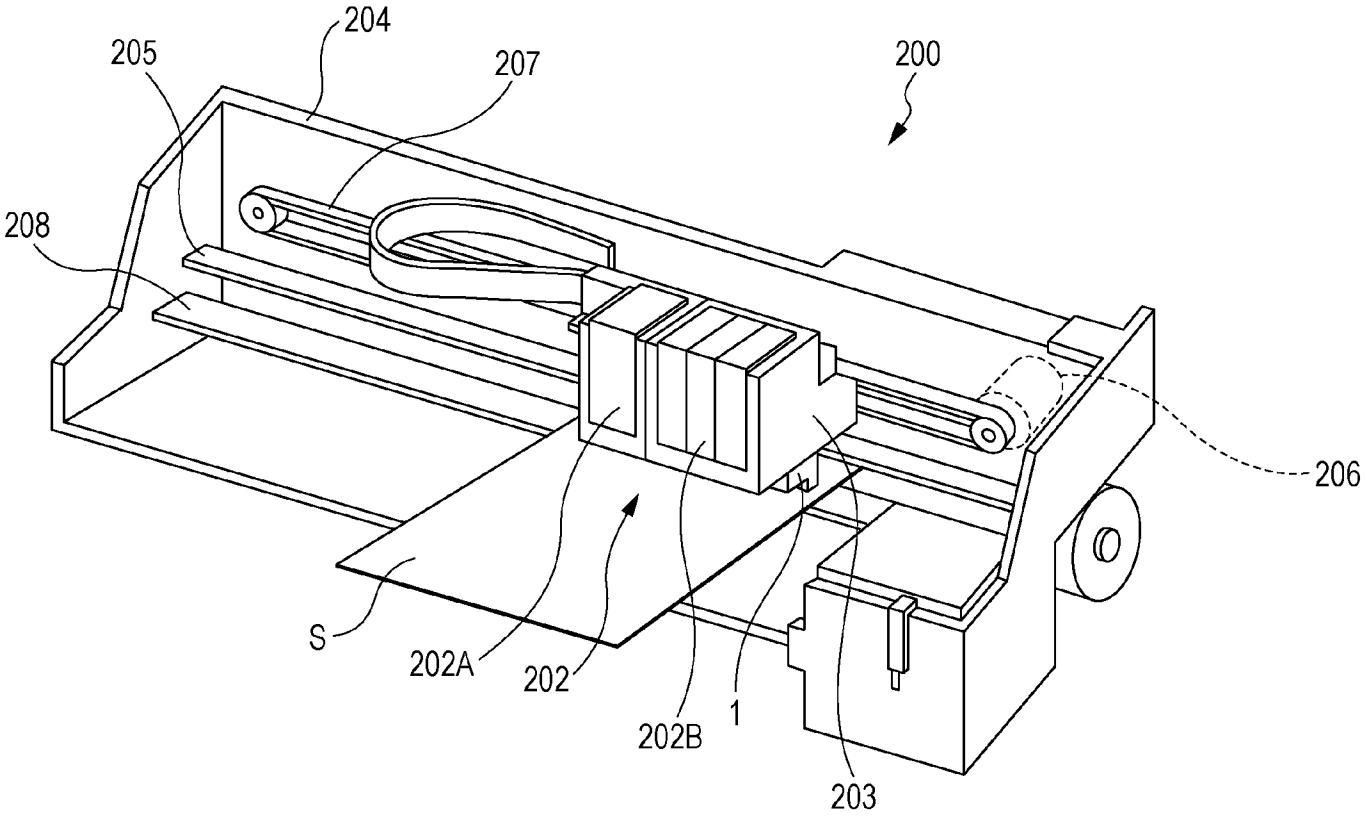
FIG. 6 is a schematic view showing an example of an ink jet printer.

FIG. 6 is a schematic view showing an example of the ink jet printer 200. Sign 1 in FIG. 6 shows a part of a housing (head cover) that accommodates the liquid ejecting head 10 while exposing a nozzle opening surface thereof to the outside. In the ink jet printer 200, ink cartridges 202A and 202B or the like are removably disposed in the ink jet type recording head unit (hereinafter, head unit 202) which includes a plurality of the liquid ejecting heads 10. A carriage 203 on which the head unit 202 is mounted is disposed in an axially movable manner in a carriage shaft 205 mounted on an apparatus main body 204. When a driving force of a drive motor 206 is transmitted to the carriage 203 via a plurality of gears, which are not shown herein, and a timing belt 207, the carriage 203 moves along the carriage shaft 205.

A platen 208 is disposed along the carriage shaft 205 in the apparatus main body 204, and a printing medium S that is supplied by a roller or the like, which is not shown herein, is transported on the platen 208. The ink is ejected from the nozzle 61 of the liquid ejecting head 10 onto the printing medium S that is transported so that an image is printed onto the printing medium S. The ink jet printer 200 may be a so-called line head type printer in which not only the head unit 202 is moved as described above but also, for example, printing is performed by moving only the printing medium S with the liquid ejecting head 10 being fixed.

Also, the invention can also be applied to a liquid ejecting head and a liquid ejecting apparatus ejecting a liquid other than ink. Examples of the liquid ejecting head include a color material ejecting head that is used for manufacturing a color filter of a liquid crystal display or the like, an electrode material ejecting head that is used for forming an electrode of an organic EL display or a field emission display (FED), and a bio-organic material ejecting head that is used for biochip manufacturing. The invention can also be applied to a liquid ejecting apparatus on which the liquid ejecting head is mounted.

The entire disclosure of Japanese Patent Application No. 2013-018384, filed Feb. 1, 2013 is incorporated by reference herein.

What is claimed is:

1. A flow path component comprising:

a first flow path member that includes a first flow path;

a second flow path member that includes a second flow path which communicates with the first flow path;

a covering layer that coats a wall surface of the first flow path; and an adhesion layer that adheres the first flow path member and the second flow path member with each other and partially enters the first flow path and covers at least a part of an end portion of the covering layer, wherein the adhesion layer covers a peeling section that is peeled off from the wall surface of the first flow path in an end portion of the covering layer.

2. The flow path component according to claim 1, wherein at least a part of the first flow path of the first flow path member is a pressure chamber that applies pressure to a liquid which is supplied.

3. The flow path component according to claim 1, wherein the second flow path member includes a flow path that causes the first flow path to communicate with a nozzle which ejects a liquid passing through the first flow path as the second flow path.

4. The flow path component according to claim 1, wherein the second flow path member includes a nozzle that ejects a liquid passing through the first flow path as the second flow path.

5. The flow path component according to claim 1, wherein the covering layer is a protective film formed of a paraxylene-based polymer.

6. A liquid ejecting apparatus mounted with the flow path component comprising:

a first flow path member that includes a first flow path;

a second flow path member that includes a second flow path which communicates with the first flow path;

a covering layer that coats a wall surface of the first flow path; and an adhesion layer that adheres the first flow path member and the second flow path member with each other and partially enters the first flow path and covers at least a part of an end portion of the covering layer, wherein the adhesion layer covers a peeling section that is peeled off from the wall surface of the first flow path in an end portion of the covering layer.

7. A liquid ejecting apparatus mounted with the flow path component according to claim 6, wherein at least a part of the first flow path of the first flow path member is a pressure chamber that applies pressure to a liquid which is supplied.

8. A liquid ejecting apparatus mounted with the flow path component according to claim 6, wherein the second flow path member includes a flow path that causes the first flow path to communicate with a nozzle which ejects a liquid passing through the first flow path as the second flow path.

9. A liquid ejecting apparatus mounted with the flow path component according to claim 6, wherein the second flow path member includes a nozzle that ejects a liquid passing through the first flow path as the second flow path.

10. A liquid ejecting apparatus mounted with the flow path component according to claim 6, wherein the covering layer is a protective film formed of a paraxylene-based polymer.

11. A flow path component comprising:

a first flow path member that includes a first flow path;

a second flow path member that includes a second flow path which communicates with the first flow path;

a covering layer that coats a wall surface of the first flow path; and an adhesion layer that adheres the first flow path member and the second flow path member with each other and covers at least a part of an end portion of the covering layer, wherein the adhesion layer covers a peeling section that is peeled off from the wall surface of the first flow path in an end portion of the covering layer.

12. The flow path component according to claim 11, wherein the covering layer is a protective film formed of a paraxylene-based polymer.

13. A liquid ejecting apparatus mounted with the flow path component according to claim 11.

14. A liquid ejecting apparatus mounted with the flow path component according to claim 12.

* * * * *